United States Patent [19]

Jungels et al.

[11] Patent Number: 4,795,057

[45] Date of Patent: Jan. 3, 1989

[54] TRANSPORT AND/OR STORAGE CONTAINER, PARTICULARLY FOR A FLUID AND/OR A FINE GRAINED LOOSE MATERIAL

[75] Inventors: Erwin Jungels; Pierre Pfeiffer, both of Drulingen; Benoît Cheval, Saverne; Paul Sigwalt, Drulingen, all of France

[73] Assignee: Sotralentz S.A., Drulingen, France

[21] Appl. No.: 33,979

[22] Filed: Apr. 1, 1987

[30] Foreign Application Priority Data

Apr. 1, 1986 [FR] France ..... 86 04740

[51] Int. Cl.[4] ..... B65N 19/00

[52] U.S. Cl. ..... 220/401; 220/1.5; 220/19; 220/72.1; 206/386

[58] Field of Search ..... 220/401, 19, 1.5, 18.1, 220/72.1, 73, 84; 206/386, 597; 383/119

[56] References Cited

U.S. PATENT DOCUMENTS 4,090,633 5/1978 Trubiano ..... 220/1.5
4,173,289 11/1979 Nesti ..... 220/1.5
4,676,373 6/1987 Schneider ..... 220/401

FOREIGN PATENT DOCUMENTS 132853 11/1978 Fed. Rep. of Germany ..... 206/386

*Primary Examiner*—Willis Little
*Attorney, Agent, or Firm*—Herbert Dubno

[57] ABSTRACT

The transport and/or storage container comprises a container base in the shape of a pallet with a plurality of planks positioned parallel to each other having a plurality of supporting surfaces, an inner container in the form of a substantially rectangular parallelepiped shape plastic tank with a plurality of rounded edges and corners and a supporting container which at least peripherally surrounds the inner container. The supporting container has a supporting container jacket comprising a plurality of vertical and horizontal steel rods which are welded together at the crossing points of the steel rods and are connected in an upper steel frame by welding. A lower steel frame having an L-shape cross section is attached with a horizontal flange on the supporting surfaces. A plurality of flat steel bars running substantially parallel to the planks of the supporting surfaces and/or transversely or diagonally are welded to the lower frame of the supporting container. The supporting container is also stabilized by a plurality of corner reinforcing members mounted on the upper steel frame and/or inserted in the upper steel frame.

10 Claims, 4 Drawing Sheets

TRANSPORT AND/OR STORAGE CONTAINER, PARTICULARLY FOR A FLUID AND/OR A FINE GRAINED LOOSE MATERIAL

FIELD OF THE INVENTION

Our present invention relates to a transport and/or storage container and, more particularly, to a transport and storage container for a fluid or for a fine grained loose bulk or flowable solid material.

BACKGROUND OF THE INVENTION

A transport and/or storage container designed particularly for a fluid and/or a fine grained loose material can comprise a container base in the form of a pallet with a mounting surface on planks positioned parallel to each other, a substantially rectangular parallelepiped inner container with rounded corners and edges and a supporting structure which surrounds the inner container at least peripherally.

The supporting structure can be a cage formed of a plurality of vertical steel rods and horizontal steel rods which are attached to each other at crossing points by welding.

The vertical steel bars are connected to upper and lower frames by welding.

The lower steel frame can have an L-shape cross section and is mounted on the supporting surface of the pallet with its horizontal flange. The method of attachment can be by screws and/or nails. Usually the pallet is composed of wood. It can also be made of a plastic material or metal, for example metal wire.

The support structure can be made from a standard steel mat.

The inner container can be a plastic tank, e.g. made by blow molding.

The upper steel frame can be made in a variety of ways in such a transport and/or storage container. It can have an L-shape cross section. It can also be a pipe or rod which has a passage for insertion of vertical steel rods or comprises one or more steel rods which form the support structure. The support structure can be reinforced by cross tie members or reinforcing rods which are attached to the upper steel frame after insertion of the plastic tank in the support structure.

In the scope of the invention a cover contacting on the plastic tank can be inserted on the support structure. The cover can be formed from a concrete steel reinforcing mat. It can be attached to the upper steel frame or held by it. The pallet is widely used and, even internationally, of standard size. Preferably a so-called four entrance pallet, i.e. a pallet with four entrances for the arms of the forklift truck. That is also true for the concrete steel mat.

The strength and stability of the known unit as taught in German Patent Document No. 30 39 635 are chiefly determined by the pallet and the lower and the upper steel frames while the support structure jacket contributes less to the strength and stability.

When the plastic tank has received a large mass, e.g. a fluid of a high specific gravity and a large transport load which have to be coped with in loading, the stability and the strength must necessarily be higher than normal. To improve strength and stability one can strengthen the structure described above. Unfortunately this is not possible at least when a standard steel mat is used since the standard pallet and support structure surface cannot be arbitrarily strengthened.

OBJECTS OF THE INVENTION

It is an object of our invention to provide an improved transport and/or support structure for a fluid or a fine grained loose material which avoids the last-mentioned drawbacks.

It is another object of our invention to provide an improved transport and/or support structure for a fluid or a fine grained loose material in which the strength and stability are considerably increased with simple means.

It is a further object of our invention to provide an improved transport and/or support structure in which the strength and stability of the pallet which is used in the standard structure for the transport and/or support structure is increased while the support structure can be made in the usual way from a standard steel mat.

SUMMARY OF THE INVENTION

These objects and others which will become more readily apparent hereinafter are attained in accordance with our invention in a transport and/or storage container, particularly for a fluid and a fine grained loose material, comprising a container base in the shape of a pallet with a plurality of planks positioned parallel to each other having a plurality of supporting surfaces, an inner container in the form of a substantially rectangular parallelepiped plastic tank (e.g. a generally cubic tank) with a plurality of rounded edges and corners, and a support structure which at least peripherally surrounds the inner container.

The support structure comprises a plurality of vertical and horizontal steel rods which are welded together at the crossing points of the steel rods and are connected to an upper steel frame by welding.

A lower steel frame has an L-shape cross section, is mounted with a horizontal flange on the supporting surfaces and is attached thereto by a plurality of screws and/or nails.

According to our invention a plurality of flat steel bars running substantially parallel to the plane planks of the supporting surfaces and thus the pallet are welded to the lower frame of the support structure. The flat steel bars which can be perpendicular to the planks or diagonal with respect to a plan view of the frame, simultaneously stabilize the lower steel frame, the pallet and the support structure. The support structure is also stabilized by a plurality of corner reinforcing members mounted on the upper steel frame and/or inserted in the upper steel frame. The flat steel bars whether perpendicular to the planes or diagonal, are transverse to the planks.

A suitable measurement or length for the flat steel bars is required so that the flat steel bars simultaneously stabilize the lower steel frame, the pallet and the support structure.

They can also be replaced by a metal plate covering all or part of the supporting surfaces as long as, like the bars, the plate connects at least two opposite sides of the frame.

Stabilization of the pallet is attained since the lower steel frame can be attached directly by screws or nails with the pallet so that the stabilization and reinforcement of the lower steel frame by the bars or plate simultaneously provides a stabilization of the pallet.

Simultaneously of course the support structure is reinforced especially in the vicinity of its attachment to the pallet.

The strength of the unit can be further improved by attaching corner reinforcing members to the cage structure. The stress and strain during transport depend on the dynamic forces the unit experiences. To prevent uncontrollable stresses and strains from developing in response to the dynamic forces the plastic tank is slid into the support structure and to prevent stresses from damaging the plastic tank our invention teaches that a plurality of supporting elements can be attached to the lower steel frame and the upper steel frame for engagement and support of the rounded edges and/or corners of the plastic tank.

There are several possible variants of this aspect of our invention. For example the corner reinforcing members can be made of a plastic material. We have found it to be better, however, to make the corner reinforcing members of steel plate and to attach them to the upper steel frame by welding.

The supporting elements for the edges and corners of the plastic tank can be formed from a plastic material, e.g. plastic foam. They can also be made of steel plate.

More specifically the supporting elements for the rounded edges can have a substantially triangular open cross section with an insertion slot running along one side. The horizontal flange of the lower steel frame of the support structure is insertable in the insertion slot.

In another aspect of the invention a plurality of supporting elements acting as a reinforcement of the support structure are provided in the form of metal plate shells fitting the corners of the support structure and are attached to the lower and upper steel frame.

The advantages of our invention include a considerable improvement in the strength and stability of the transport and/or support structure since the flat steel bars are mounted in the described way and simultaneously the lower steel frame and thus the pallet and the support structure are stabilized. Corner reinforcing members also contribute to the improved strength and stability. The supporting elements provided also help the unit handle the dynamic load on the support structure in transport.

BRIEF DESCRIPTION OF THE DRAWING

The above and other objects, features and advantages of our invention will become more readily apparent from the following description, reference being made to the accompanying highly diagrammatic drawing in which:

FIG. 5A is a detail showing another attachment for the corner reinforcement.

SPECIFIC DESCRIPTION

Figure 1:
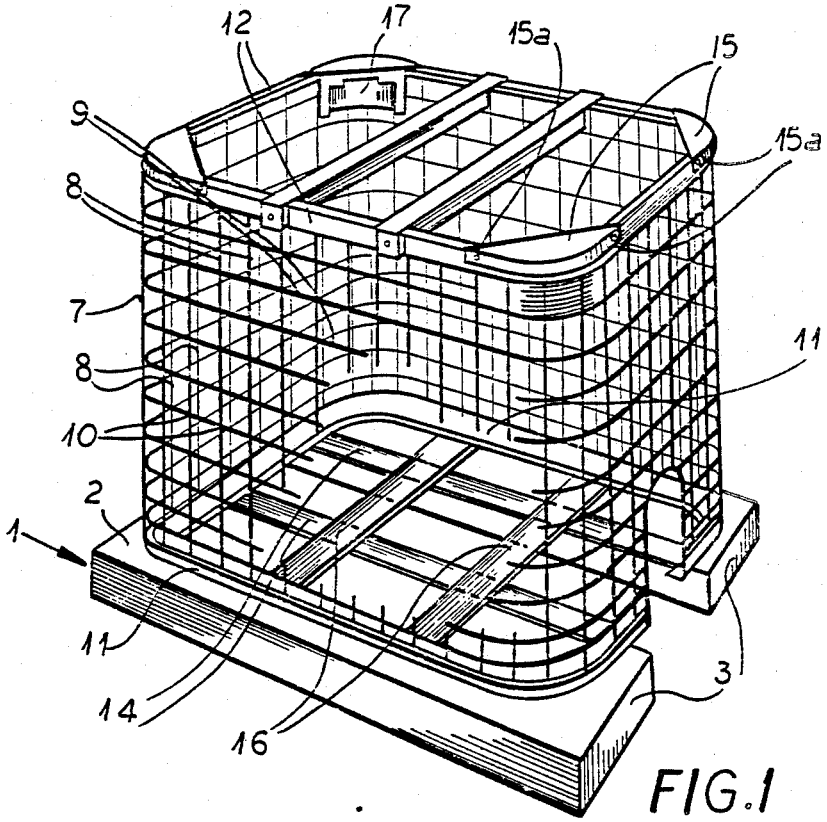
FIG. 1 is a perspective view of a transport and/or a storage container according to our invention without the plastic tank.

The transport and/or storage container shown in the drawing is designed particularly for a fluid and for a fine grained loose material. It comprises a container base in the form of a pallet with supporting surfaces 2 on planks 3 positioned parallel to each other, a substantially rectangular parallelepiped shape inner container 4 with rounded corners 6 and edges 5 and a support structure 7 which surrounds the inner container 4 at least peripherally.

The pallet 1 has been illustrated highly schematically. In practice it can be a conventional four way pallet.

The support structure 7 has a support structure in the form of a cage comprising a plurality of vertical steel rods 8 and horizontal steel rods 9 which are attached to each other at crossing points 10 by spot welding. The structure 8,9 can be formed from a standard steel mat.

The support structure 8,9 is mounted on and supported with a lower steel frame 11 and an upper steel frame 12 and is attached to the upper steel frame 12 by welding.

The lower steel frame 11 has an L-shape cross section and is mounted on the supporting surfaces 2 of the pallet 1 with the horizontal flange 13 of lower steel frame. The method of attachment can be by screws and/or nails.

Figure 2:
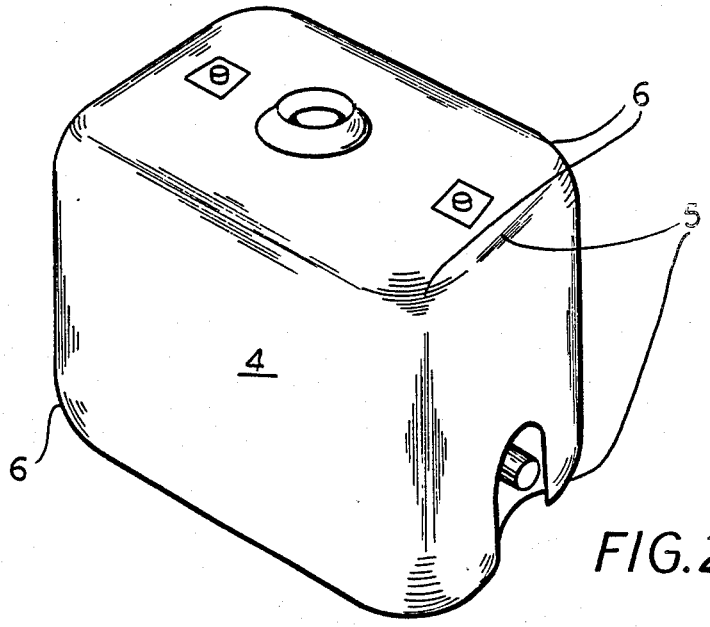
FIG. 2 is a perspective view of a plastic tank designed to be inserted in the unit shown in FIG. 1.
Figure 3:
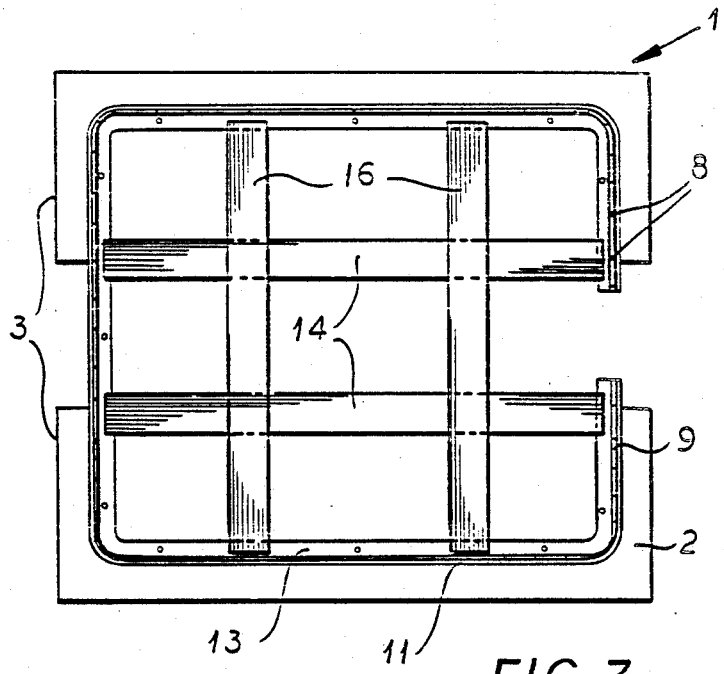
FIG. 3 is a cross sectional view through the unit of FIG. 1 with the section being taken in a horizontal plane.
Figure 4:
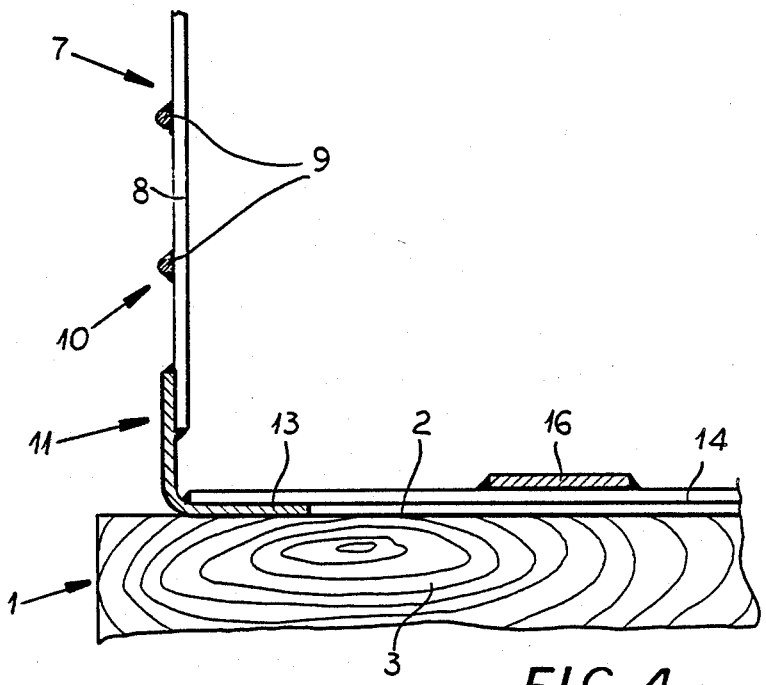
FIG. 4 is a partially broken away vertical cross sectional view through the unit of FIG. 1.

Particularly from a comparison of FIGS. 1 to 3 one sees that flat steel bars 14 running substantially parallel to the planks 3 of the supporting surfaces 2 and bars 16 transverse to the planks are welded to the lower steel frame 11 of the support structure 7.

This arrangement affords a simultaneous stabilization of the lower steel frame 11 and thus of the support structure 7 and also the pallet 1 to which the lower frame 11 is attached in the way described above results.

The support structure 7 is moreover stabilized by corner reinforcing members 15 attached to it and/or mounted on the upper steel frame 12. The corner reinforcing members 15 can be attached to the upper steel frame 12 by the screws 15a, better seen in FIG. 6A, traversing the flange 15'. Alternatively a welded connection (FIG. 6) can be provided. Within the scope of our invention it is also possible to surround the support structures 7 with steel strapping to stabilize it further which however has not been shown in the drawing.

Figure 5:
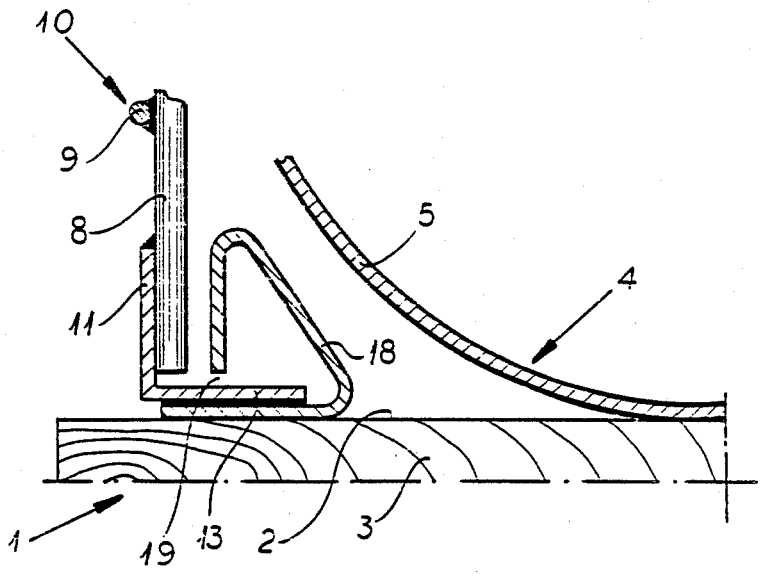
FIG. 5 is an enlarged partially broken away vertical cross sectional view through another embodiment of the unit of FIG. 1 similar to that of FIG. 4.
Figure 6:
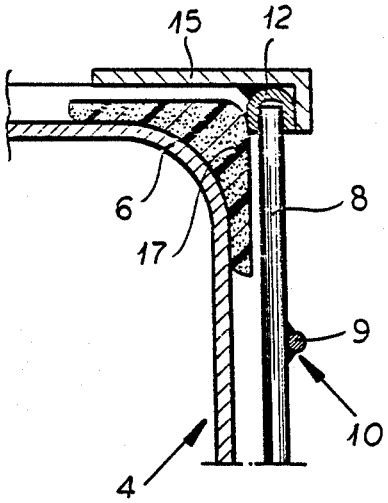
FIG. 6 is an enlarged vertical cross sectional view of the upper portion of the frame of FIG. 5 in the same scale as FIG. 5.
Figure 6A:
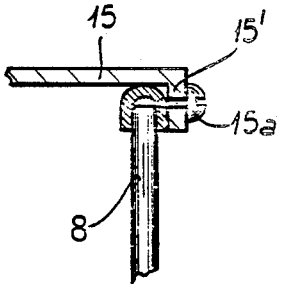

In FIGS. 1, 5 and 6 one sees that supporting elements 17, 18 bracing the rounded edges 5 and/or corners 6 of the plastic tank 4 are attached to the lower steel frame 11 and the upper steel frame 12. The corner reinforcing members 15 are formed in this example from steel plate and attached with the upper steel frame 12 by screws **15*a*. They can be easily removed of course and screwed on again to make the mounting or replacement of the inner container 4 easy. The supporting elements 17 for the corners 6 are formed in this example from a plastic material, particularly from plastic foam, as FIG. 6** shows.

FIG. 5 shows an alternative method of attachment of the lower frame 11 to the planks 3. The supporting elements 18 for the rounded edges 5 have a substantially triangular open cross section with insertion slots 19 running along one side. The horizontal flange 13 of the lower steel frame 11 of the support structure 7 is pushed in these slots 19. This is illustrated in FIG. 5 particularly. Both parts can be attached to each other by welding. The attachment of the unit with the pallet 1 occurs by screwing or by nails.

Figure 7:
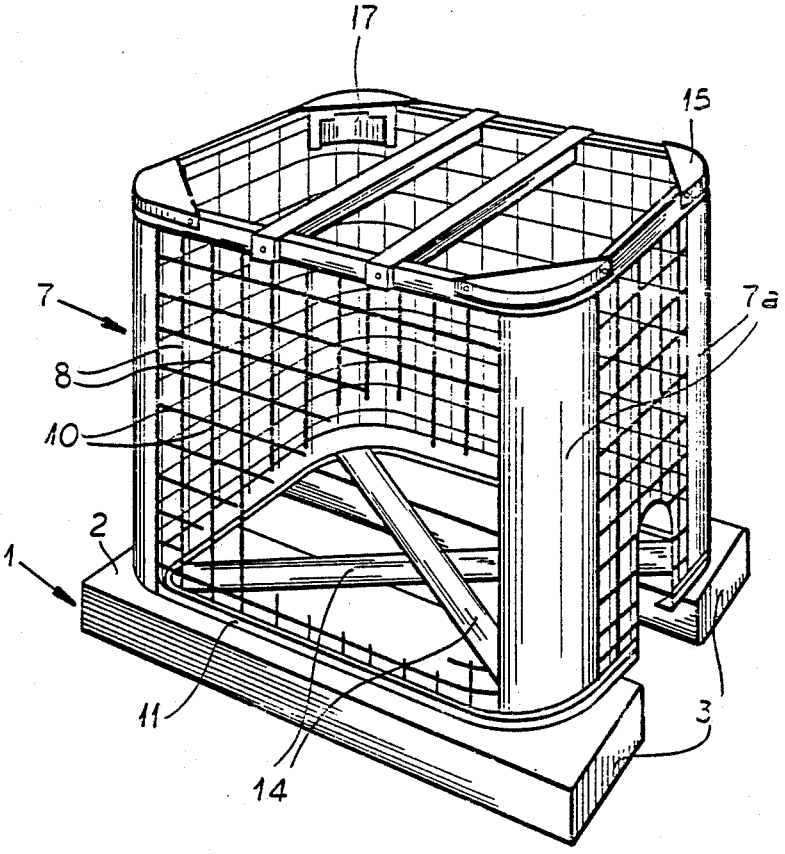
FIG. 7 is a view similar to FIG. 1 showing a modification.

As can be seen in FIG. 7, the steel bars or straps 14 can extend diagonally across the frame 11 to be welded to opposite sides thereof. The corners of the cage structure can be additionally stabilized by steel corner members *7a* in the form of steel shells welded to the upper and lower frames.

We claim:

1. In a transport and/or storage container for a flowable material, comprising a container base in the form of a pallet with a plurality of planks positioned parallel to each other having a plurality of supporting surfaces, an inner container in the form of a substantially rectangular parallelepiped plastic tank with a plurality of rounded edges and corners and a support structure which at least peripherally surrounds said inner container, said support structure having a support cage comprising a plurality of vertical and horizontal steel rods which are welded together at crossing points and are connected to a lower and an upper steel frame by welding, said lower steel frame having an L-shape cross section and being mounted with a horizontal flange thereof on said supporting surfaces, the improvement which comprises a plurality of flat steel bars generally transverse to said planks and welded to opposite sides of said lower steel frame, said flat steel bars simultaneously stabilizing said lower steel frame, said pallet and said support structure, and a plurality of corner reinforcing members mounted on said upper steel frame for further stabilizing said support structure.

2. The improvement according to claim 1, further comprising a plurality of supporting elements attached to said lower steel frame and said upper steel frame and bracing against said rounded edges and/or said rounded corners of said plastic tank.

3. The improvement according to claim 2 wherein said corner reinforcing members are made of steel plate and are attached with said upper steel frame by a plurality of screws.

4. The improvement according to claim 2 wherein said supporting elements for said rounded edges and/or said rounded corners are made from a plastic material.

5. The improvement according to claim 4 wherein said plastic material is plastic foam.

6. The improvement according to claim 2 wherein said supporting elements for said rounded edges have a substantially open triangular cross section with an insertion slot running along one side thereof in which said horizontal flange of said lower frame of said support structure is inserted.

7. The improvement according to claim 1 wherein an additional plurality of said flat steel bars are provided running transverse to the first mentioned flat steel bars.

8. The improvement according to claim 1 wherein a plurality of metal shells are attached to said lower and said upper steel frame along corners of said structure.

9. The improvement defined in claim 1 wherein said bars extend along diagonals of said frame.

10. A transport and storage container for a flowable material, comprising:

a container base in the shape of a pallet with a plurality of planks positioned parallel to each other having a plurality of supporting surfaces;

an inner container in the form of a substantially rectangular parallelepiped shape plastic tank with a plurality of rounded edges and corners;

a support structure which at least peripherally surrounds said inner container having a support structure jacket including a plurality of vertical and horizontal steel rods which are welded together at the crossing points thereof a lower and an upper steel frame connected to said support structure jacket by welding, said lower steel frame having an L-shape cross section being mounted with a horizontal flange thereof on said supporting surfaces and being attached thereto;

one plurality of flat steel bars running substantially parallel to said planks of said supporting surfaces and/or across the horizontal plane of said lower steel frame and thus said pallet welded to said lower frame of said support structure, said flat steel bars simultaneously stabilizing said lower steel frame, said pallet and said support structure;

an additional plurality of said flat steel bars are provided running transverse to said one plurality of said flat steel bars;

a plurality of corner reinforcing members made of steel plate and attached with said upper steel frame by a plurality of screws mounted on said upper steel frame and/or put on said upper steel frame stabilizing said support structure; and a plurality of plastic foam supporting elements attached to said lower steel frame and said upper steel frame for said rounded edges and/or said rounded corners of said plastic tank.

* * * * *